US010898038B1

(12) United States Patent
Greene

(10) Patent No.: US 10,898,038 B1
(45) Date of Patent: Jan. 26, 2021

(54) SWIVEL FLOW SEAT

(71) Applicant: Roi Greene, Philadelphia, PA (US)

(72) Inventor: Roi Greene, Philadelphia, PA (US)

( * ) Notice: Subject to any disclaimer, the term of this patent is extended or adjusted under 35 U.S.C. 154(b) by 0 days.

(21) Appl. No.: 16/661,417

(22) Filed: Oct. 23, 2019

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/239
See application file for complete search history.

(56) References Cited

U.S. PATENT DOCUMENTS 5,347,662 A * 9/1994 Carper-White ..... A47K 13/00 4/237
8,316,472 B1 * 11/2012 Martin ..... A47K 13/24 4/239

* cited by examiner

*Primary Examiner* — Christine J Skubinna
(74) *Attorney, Agent, or Firm* — Bruce A. Lev

(57) ABSTRACT

A toilet seat unit structured and arranged to freely swivel in both left and right directions, a full 360 degrees to provide a user, especially a handicapped user, a toilet seat that increases comfort and facilitates freedom of movement while utilizing a bathroom facility. The toilet seat also has built in LED lights, a digital body weight scale, a vibration system, a lock system, and an inner safety guard.

19 Claims, 3 Drawing Sheets

SWIVEL FLOW SEAT

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of toilet seat devices and more specifically relates to an improved toilet seat structured and arranged to freely swivel in both left and right directions, a full 360 degrees to provide a user especially a handicapped user a toilet seat that increases comfort and facilitates freedom of movement while utilizing a bathroom facility.

2. Description of the Related Art

One of the most useful and practical rooms in any household is the bathroom. The bathroom is the one room in the home where people shower or bathe, brush their teeth, shave, apply make-up, and undergo other personal grooming tasks. Perhaps most importantly, the bathroom houses that most necessary of items: the toilet. Although difficult to discuss, the need to use the toilet is something every human being shares in common. Since 1596, when the first flushing toilet was invented by author Sir John Harrington for his godmother, Queen Elizabeth I, the "water closet" has evolved into the efficient, closed tank and bowl system common today. While an accessible toilet is something that is found in every home and business, this most utilitarian of items still possess limitations.

One such drawback in modern toilet designs is the seat. Securely mounted to the bowl to serve as a buffer between the user and the water in the bowl, the seat can prove quite uncomfortable and unyielding at times. For instance, users who may have limited physical abilities due to illness or age often have trouble easily positioning themselves on the immovable seat when needing to sit, get up, or attend to their person while on the toilet. For healthy individuals as well as the disabled, the stationary seat can pose a problem should one need to access an item that is slightly out of reach, such as a ringing cellphone or a new roll of toilet tissue.

Various attempts have been made to solve problems found in toilet seat device art. Among these are found in: U.S. Pat. No. 8,316,472 to Robert C. Martin; U.S. Pat. No. 4,951,328 to Alfred Potvin; and U.S. Pat. No. 5,347,662 to Sharon Carper-White. This prior art is representative of toilet seats comprising swivel means.

Ideally, a swivel flow seat should be user-friendly and safe in-use and, yet should operate reliably and be manufactured at a modest expense. Thus, a need exists for an improved toilet seat structured and arranged to freely swivel in both left and right directions, a full 360 degrees to provide a user, especially a handicapped user, a toilet seat that increases comfort and facilitates freedom of movement while utilizing a bathroom facility and to avoid the above-mentioned problems.

BRIEF SUMMARY OF THE INVENTION

In view of the foregoing disadvantages inherent in the known toilet seat device art, the present invention provides a Swivel Flow Seat. The general purpose of the present invention, which will be described subsequently in greater detail is to provide an improved toilet seat structured and arranged to freely swivel in both left and right directions, a full 360 degrees to provide a user, especially a handicapped user, a toilet seat that increases comfort and facilitates freedom of movement while utilizing a bathroom facility.

In a toilet seat having a top surface with an opening forming an inner rim, the presently claimed invention includes a swivel seat member and a swivel assembly. The swivel seat member has a top portion, a bottom portion, and an aperture. The top portion and the bottom portion both have an outer edge portion. The aperture is formed through the top portion and bottom portion and forms an inner rim.

The swivel assembly includes a base plate with an inner edge portion, a master ring, and a circular bearing. The base plate is removably secured to the top portion of the toilet seat. The master ring is attached to the bottom portion of the toile seat. The circular bearing is attached between the base plate and the master ring and is adapted to allow rotary movement therebetween. The swivel seat member is adapted to allow a user to swivel upon the toilet seat when in use.

The present invention holds significant improvements over what is currently available on the market. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention that are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an improved toilet seat having top surface and aperture therethrough forming an inner rim entitled Swivel Flow Seat, constructed and operative according to the teachings of the present invention.

The various embodiments of the present invention will hereinafter be described in conjunction with the appended drawings, wherein like designations denote like elements.

DETAILED DESCRIPTION

Figure 1A:
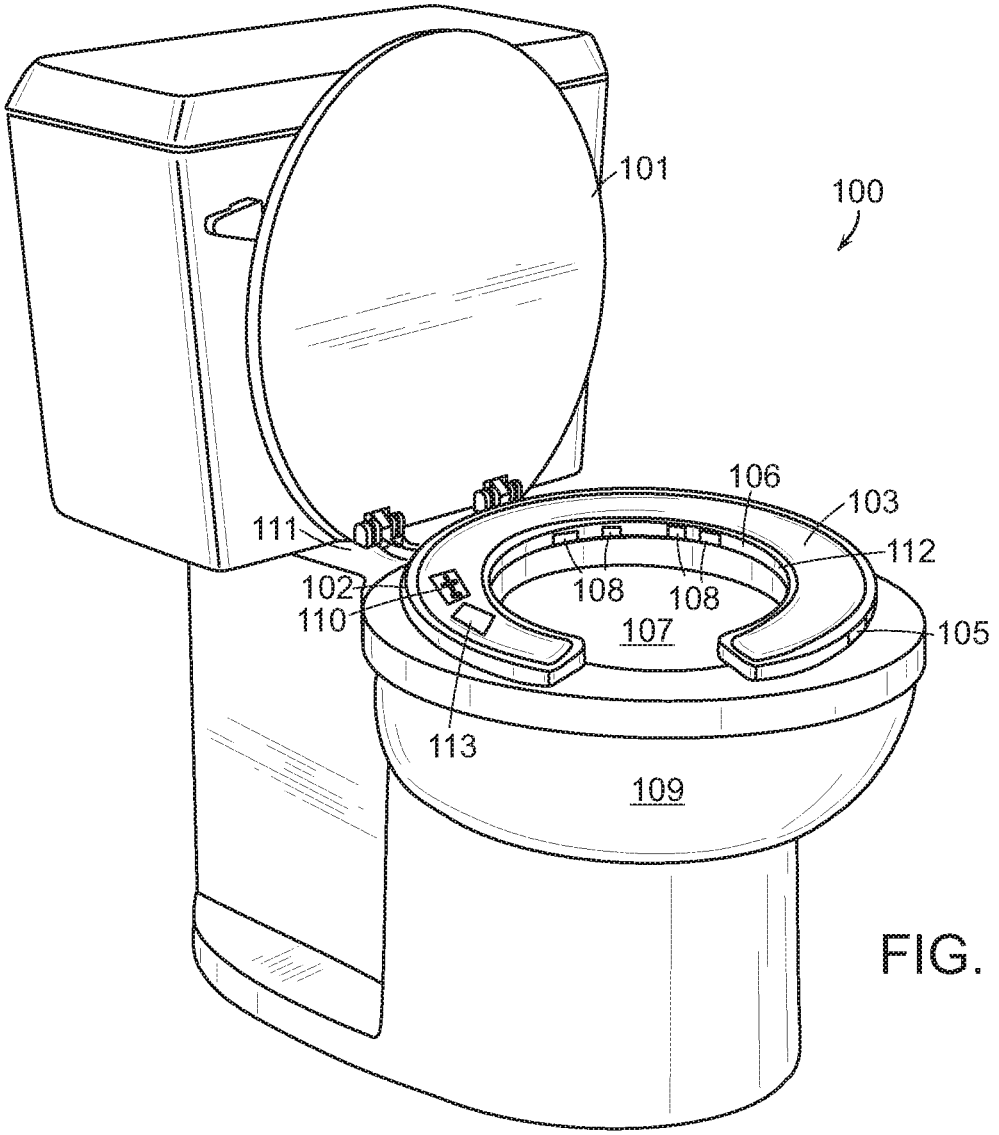
FIG. 1A shows a perspective view illustrating an improved toilet seat having a U-Shape design with a top surface and aperture according to an embodiment of the present invention.

As discussed above, embodiments of the present invention relate to a toilet seat device and more specifically relates to an improved toilet seat structured and arranged to freely swivel in both left and right directions, a full 360 degrees to provide a user, especially a handicapped user, a toilet seat that increases comfort and facilitates freedom of movement while utilizing a bathroom facility.

Generally speaking, the Swivel Flow Seat would resemble a standard toilet seat, and may be produced in a variety of materials including but not limited to plastic, wood, or rubber padding. Additionally, the unit would be made in all shapes and existing sizes, as well as in a variety of colors and designs, to accommodate both rounded and oval, elongated toilet bowls, as well as match existing bathroom décor.

Unique to the Swivel Flow Seat and what sets it apart from common variety of toilet seats is its rotation assembly and other special features. The underside of the seat preferably comprises a three-tiered configuration including a unit stabilizer (base plate), core circle (circular bearing), and master ring. In addition to securing and stabilizing the seat onto any standard mount, these components will preferably feature an integrated pivoting axle or circular bearing, which will provide the unit's swiveling capabilities. Thus constructed, the Swivel Flow Seat, when installed onto a toilet bowl and put into operation, would allow for complete, unimpeded movement from left to right and back again—essentially, 360 degrees of rotation.

Allowing for complete side-to-side rotation, the Swivel Flow Seat will preferably permit a user to sit as per usual, and if needed, simply rotate in the direction he or she needs to go, whether to reach for something or for any other reason, without repositioning the body in an awkward position or having to get up from the seat to do so. With the free range and accessibility offered here, users can attend to any needed task that presents itself at this delicate time with expedience and simplicity. For example, one may choose to grab additional toilet paper, or ever read, talk business, chat on the phone, paint their toenails, apply make-up, or even just have a smoke, all easily done with the freedom of movement this product allows.

The Swivel Flow Toilet Seat would be especially beneficial to those with mobility limitations, by helping these users better position themselves without stress or strain. With the unit's rotating assembly rotating a full 360 degrees, this invention would work to facilitate free movement, without worry of damaging toilet seat parts should the need to move around arise. Indeed, the Swivel Flow Seat will preferably foster a renewed sense of independence and self-sufficiency in those who need it. Not just for home use, the Swivel Flow Seat will preferably be very beneficial to hospitals, nursing homes and rehabilitation centers. Businesses and other venues might also find the Swivel Flow Toilet Seat an attractive and useful addition.

Referring now to FIGS. 1-4, showing perspective views illustrating the claimed toilet seat unit 100 having a lid 101, a toilet seat 102 with a top surface 103, a bottom surface 104, an outer rim 105, an inner rim 106, and an aperture 107 according to an embodiment of the presently claimed invention of FIG. 1. The inner rim 106 of the toilet seat 102 forms the outer circumference of the aperture 107. The seat 102 is attached to the toilet seat unit 100 by a detachable lock and click system 111 that allows the seat 102 to be removed for easy cleaning and for dismantling/installing the rest of the toilet seat unit 100.

An inner safety guard 112, a curved plastic piece, lines the entire inner rim 106 of the toilet seat 102. One or more light-emitting diode (LED) lights 108 are located on the inner safety guard 112 of the toilet seat 102. The LED lights 108 illuminate the inner rim 106 of the seat 102 and the inside of the toilet bowl 109 below the seat 102 to allow for greater visibility. The inner safety guard 112 protects and houses the LED lights 108 and prevents debris from entering the inner parts of the toilet seat unit 100.

The toilet seat 102 has an integrated digital scale 110 to determine the body weight of a user 10. The scale 110 may alternately be located in the swivel seat member, with the toilet seat acting as the weighing stand. A user 10 can acquire his or her weight both before and after elimination to determine the amount excreted. The toilet seat 102 also has an integrated vibration motor 113 that vibrates the seat to help stimulate blood flow, relax stomach muscles, help relieve cramps, and provide stimuli to the user 10 while using the toilet.

Figure 1B:
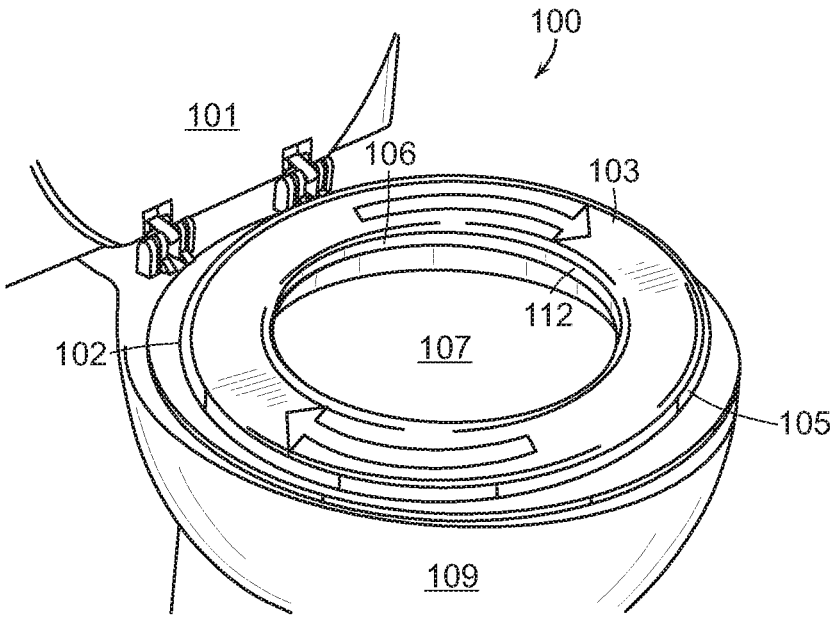
FIG. 1B shows a perspective view illustrating an improved toilet seat having a circular-shaped design with a top surface and aperture according to an embodiment of the present invention.

As shown in FIG. 1A, the toilet seat 102 may be U-shaped. As shown in FIG. 1B, the toilet seat 102 may be circular-shaped. It should be noted that the toilet seat 102 may be manufactured in other shapes and designs such as oval-shaped as well.

Figure 2B:
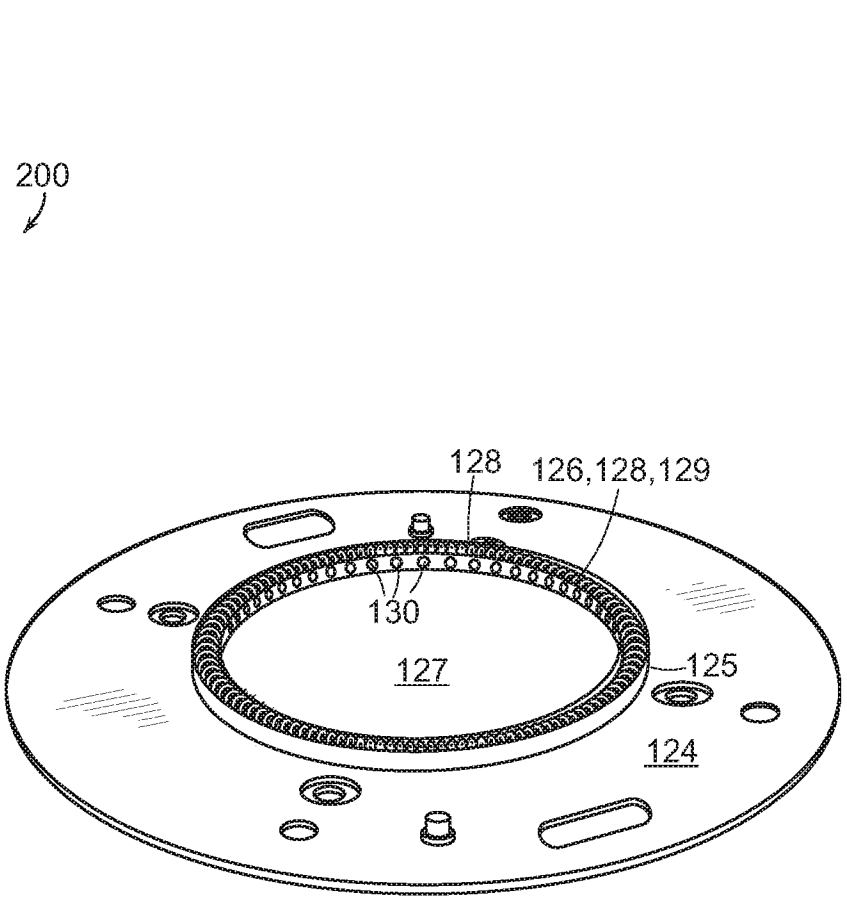
FIG. 2B shows a perspective view illustrating the base plate having an inner splash guard member of the improved toilet seat having top surface and aperture according to an embodiment of the present invention of FIG. 1.
Figure 2A:
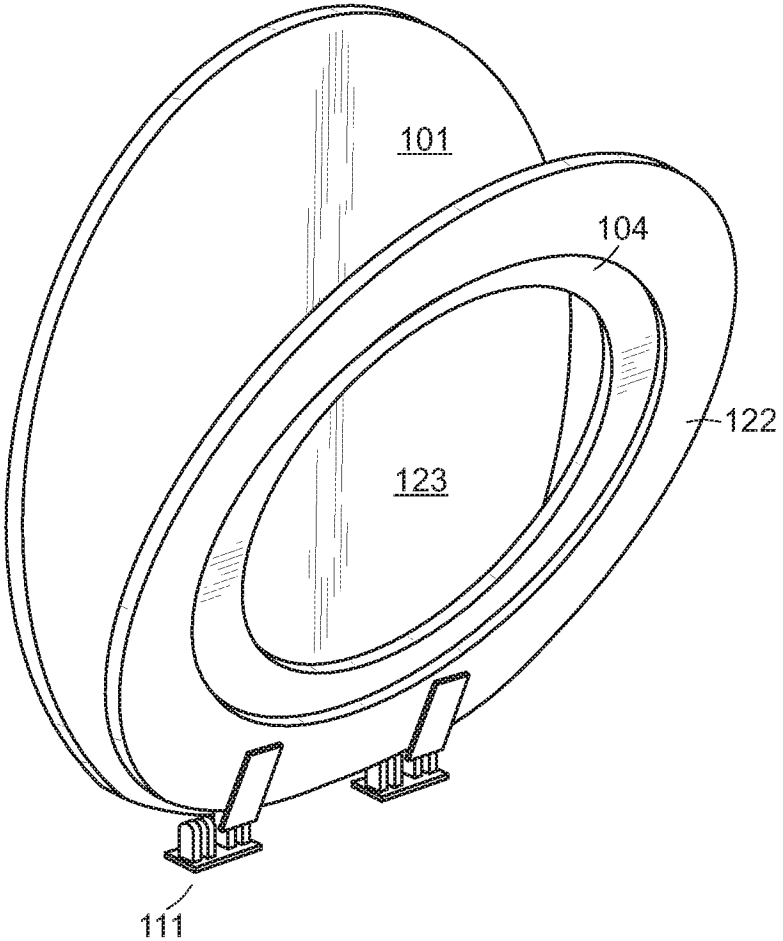
FIG. 2A shows a perspective view illustrating a swivel assembly having a base plate, master ring, and circular bearing of the improved toilet seat having top surface and aperture according to an embodiment of the present invention of FIG. 1.

As shown in FIGS. 2A and 2B, the swivel toilet seat unit 100 has a swivel seat member 200 with a swivel assembly 120. The swivel seat member 200 has a top side 121, a bottom side 122, and an aperture 123 through the middle. The top side 121 and the bottom side 122 of the swivel seat member 200 can be formed of plastic, wood, or metal, depending on the manufacturer's preferences.

The swivel assembly 120 includes a base plate 124, a master ring 125, and a circular bearing 126. The base plate 124 is removably secured to the bottom side 104 of the toilet seat 102. The base plate 124, the master ring 125, and the circular bearing 126 of the swivel assembly 120 are each formed with an aperture that concentrically aligns with the other apertures to form one aperture 127 through the swivel assembly 120. The aperture 127 of the swivel assembly 120 concentrically aligns with the aperture 107 of toilet seat 102. Both apertures 107, 127 preferably have a circular cross section.

The bottom side 104 of the toilet seat 102 is removeably and operably connected to the base plate 124 via a fastener 206 such as a strong double-sided tape, hook and loop material, glue, or a plurality of suction cups. A flex coil 128 located on top of the master ring 125 supports the toilet seat

102. The flex coil 128 supports the circular motion of the swivel toilet seat 102 and provides contour by absorbing the body weight of the user 10. The flex coil 128 also provides axle pivots every 90 degrees of the 360 degree circumference of the toilet seat unit 100. This allows the user 10 more flexibility while using the facility, providing a much-needed benefit to individuals recently out of surgery, recent stroke victims, and individuals with physical handicaps that make using a regular toilet difficult.

The circular bearing 126 is attached between base plate 124 and master ring 125 and is adapted to allow rotary movement therebetween. The circular bearing 126 includes an inner raceway 128 and an outer raceway 129 and set of balls 130 therebetween.

Figure 3:
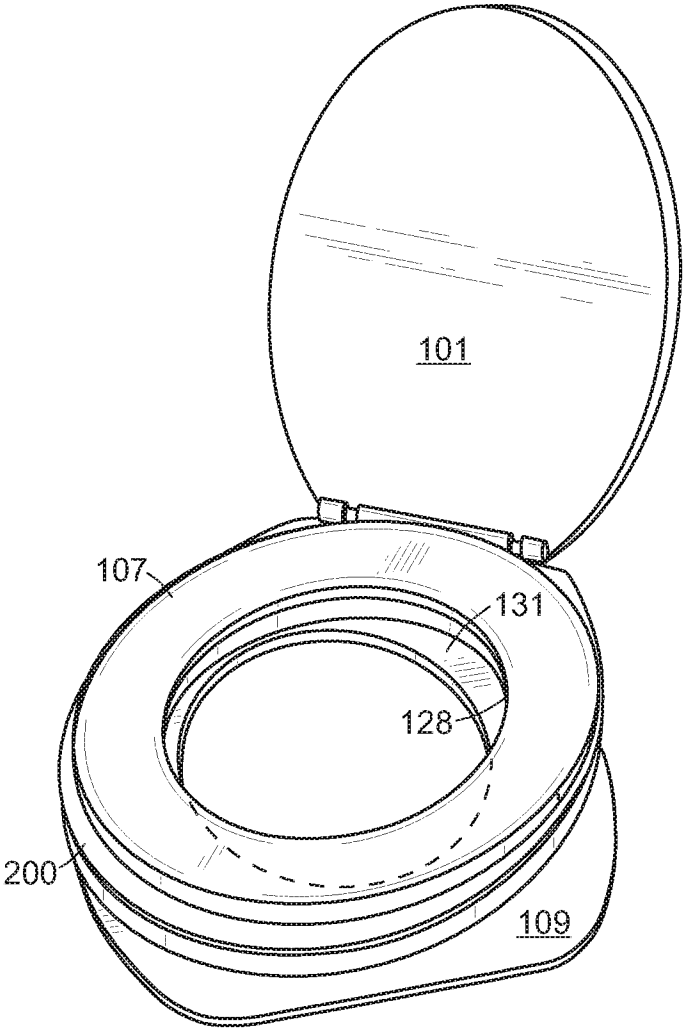
FIG. 3 shows a perspective view illustrating an inner splash guard member of the improved toilet seat having top surface and aperture according to an embodiment of the present invention of FIG. 1.

As shown in FIG. 3, the swivel toilet seat unit 100 further includes an inner splash guard member 131 attached to and extending along the circumference of the inner edge of the base plate 124. The inner splash guard member 131 extends upwardly from the base plate 124 and is adapted to cover and protect the master ring 125 and circular bearing 126 of swivel assembly 120 from water and waste splashing up. The flex coil 128 is connected between the bottom side of the seat 104 and the master ring 125 of the swivel assembly 120. The flex coil 128 includes a plurality of spaced helical spring members or one long spring.

Figure 4:
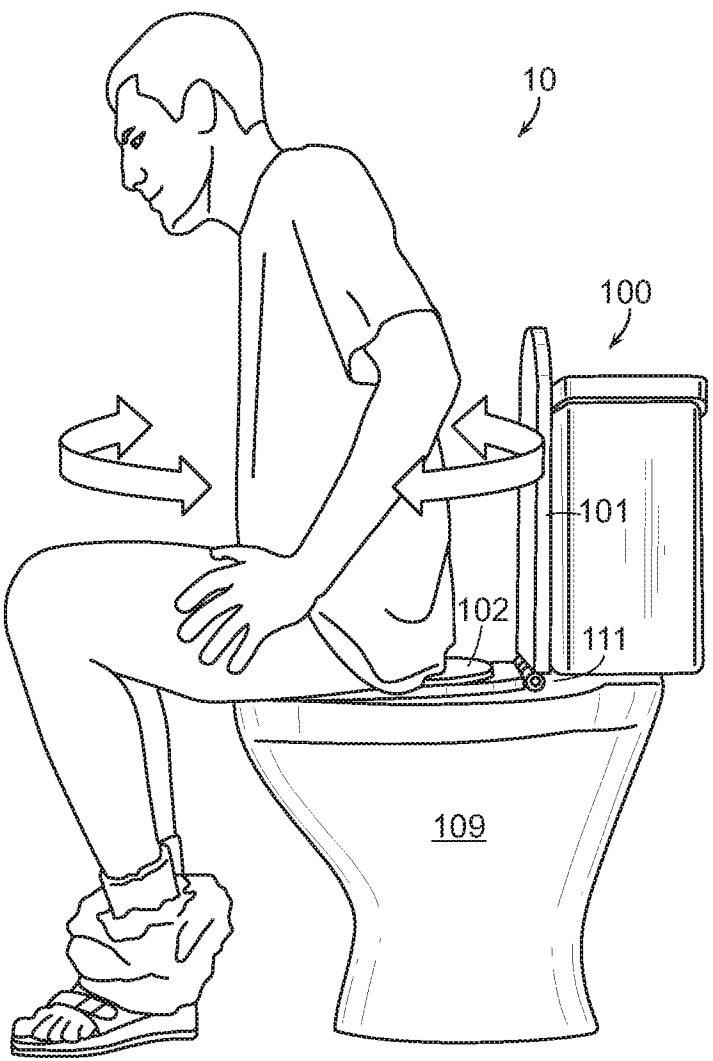
FIG. 4 shows a perspective view illustrating the improved toilet seat in an in-use condition according to an embodiment of the present invention of FIG. 1.

The swivel seat member 200 is adapted to allow a user 10 to swivel upon the toilet seat 102 when in use as shown in FIG. 4. The swivel seat member 200 allows a user 10 to swivel upon the toilet seat 102 through 360 degrees when in use.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A swivel toilet seat unit comprising:

(a) a lid;

(b) a toilet seat including (i) a top side with an outer edge and an inner edge;

(ii) a bottom side with an outer edge and an inner edge;

(iii) an outer rim between the outer edge of the top side and the outer edge of the bottom side;

(iv) an inner rim between the inner edge of the top side and the inner edge of the bottom side; and (v) an aperture formed through the toilet seat, wherein the inner rim of the seat forms an outer circumferences of the aperture; and (c) a swivel assembly including (i) a base plate having an inner edge;

(ii) a master ring;

(iii) a circular bearing including an inner raceway, an outer raceway, and a set of balls therebetween; and (iv) a flex coil operationally connected to a top of the master ring to support the toilet seat, wherein the flex coil provides axle pivots every 90 degrees of a circumference of the toilet seat;

wherein the circular bearing is operationally connected between the base plate and the master ring to allow rotary movement therebetween, wherein the base plate is removably secured to the bottom side of the toilet seat, wherein the master ring is attached to the bottom side of the toilet seat, and wherein the swivel seat member is operationally attachable to a toilet unit to allow a user to swivel the toilet seat through 360 degrees in either direction when in use.

2. The swivel toilet seat unit according to claim 1, wherein the base plate of the swivel assembly has an aperture therethrough, wherein the master ring of the swivel assembly has an aperture therethrough, wherein the circular bearing of the swivel has an aperture therethrough, wherein, when the base plate, the master ring, and the circular bearing are connected together, the aperture of the base plate, the aperture of the master ring, and the aperture of the circular bearing concentrically align and are substantially similar in shape and size, and wherein, when in use, the aperture of the base plate, the aperture of the master ring, and the aperture of the circular bearing concentrically align with the aperture of the toilet seat.

3. The swivel toilet seat unit according to claim 1, wherein the apertures of the swivel seat member, the aperture of the base plate, the aperture of the swivel assembly, and the aperture of the circular bearing all have a circular cross section.

4. The swivel toilet seat according to claim 1, further comprising:

(d) a detachable lock and click system removeably connecting the toilet seat, the lid, and the swivel assembly, wherein the detachable lock and click system is operably connected to allow the toilet seat to be removed for cleaning.

5. The swivel toilet seat unit according to claim 1, wherein the swivel assembly further comprises:

(v) a vibration motor operationally connected to vibrate the toilet seat.

6. The swivel toilet seat unit according to claim 1, wherein the toilet seat further comprises:

(vi) an inner safety guard, wherein the inner safety guard is formed from a curved plastic material, wherein the inner safety guard lines the inner rim of the toilet seat, and wherein the inner safety guard is position to prevent debris from entering the swivel assembly.

7. The swivel toilet seat unit according to claim 1, wherein the lid and the toilet seat are formed from a material chosen from a group of materials consisting of plastic, wood, and metal.

8. The swivel toilet seat unit according to claim 1, wherein the top side of the toilet seat is padded.

9. The swivel toilet seat according to claim 6, wherein the toilet seat further comprises:

(vii) one or more LED lights positioned along the inner rim of the toilet seat, wherein the one or more LED lights are housed within the inner safety guard.

10. The swivel toilet seat unit according to claim 1, wherein the swivel assembly further comprises:

(v) an integrated digital scale with a weighing mechanism and a weighing stand, wherein the toilet seat is the weighing stand, and is operationally connected to the weighing mechanism so that the integrated digital scale measures a user's weight when the user is sitting on the toilet seat.

11. The swivel toilet seat unit according to claim 1, further comprising:

(d) an inner splash guard member attached to and extending along a circumference of an inner edge of the base plate, wherein the inner splash guard member extends upward from the base plate and to cover and protect the master ring and the circular bearing of the swivel assembly from water and waste splashing thereon.

12. The swivel toilet seat unit according to claim 1, wherein the toilet seat is U-shaped.

13. The swivel toilet seat unit according to claim 1, wherein the toilet seat is circular-shaped.

14. A swivel toilet seat unit comprising:

(a) a lid;

(b) a toilet seat including (i) a top side with an outer edge and an inner edge;

(ii) a bottom side with an outer edge and an inner edge;

(iii) an outer rim between the outer edge of the top side and the outer edge of the bottom side;

(iv) an inner rim between the inner edge of the top side and the inner edge of the bottom side; and (v) an aperture formed through the toilet seat, wherein the inner rim of the seat forms an outer circumferences of the aperture;

(vi) an inner safety guard, wherein the inner safety guard is formed from a curved plastic material, wherein the inner safety guard lines the inner rim of the toilet seat, and wherein the inner safety guard is position to prevent debris from entering the swivel assembly;

(vii) one or more LED lights positioned along the inner rim of the toilet seat, wherein the one or more LED lights are housed within the inner safety guard;

(c) a swivel assembly including (i) a base plate having an inner edge;

(ii) a master ring;

(iii) a circular bearing including an inner raceway, an outer raceway, and a set of balls therebetween; and (iv) a flex coil operationally connected to a top of the master ring to support the toilet seat;

(v) a vibration motor operationally connected to vibrate the toilet seat;

(vi) an integrated digital scale with a weighing mechanism and a weighing stand, wherein the toilet seat is the weighing stand, and is operationally connected to the weighing mechanism so that the integrated digital scale measures a user's weight when the user is sitting on the toilet seat; and (d) a detachable lock and click system removeably connecting the toilet seat, the lid, and the swivel assembly, wherein the detachable lock and click system is operably connected to allow the toilet seat to be removed for cleaning wherein the flex coil provides axle pivots every 90 degrees of a circumference of the toilet seat;

wherein the circular bearing is operationally connected between the base plate and the master ring to allow rotary movement therebetween, wherein the base plate of the swivel assembly has an aperture therethrough, wherein the master ring of the swivel assembly has an aperture therethrough, wherein the circular bearing of the swivel has an aperture therethrough, wherein, when the base plate, the master ring, and the circular bearing are connected together, the aperture of the base plate, the aperture of the master ring, and the aperture of the circular bearing concentrically align and are substantially similar in shape and size, and wherein, when in use, the aperture of the base plate, the aperture of the master ring, and the aperture of the circular bearing concentrically align with the aperture of the toilet seat wherein the base plate is removably secured to the bottom side of the toilet seat, wherein the master ring is attached to the bottom side of the toilet seat, and wherein the swivel seat member is operationally attachable to a toilet unit to allow a user to swivel the toilet seat through 360 degrees in either direction when in use.

15. The swivel toilet seat unit according to claim 14, wherein the apertures of the swivel seat member, the aperture of the base plate, the aperture of the swivel assembly, and the aperture of the circular bearing all have a circular cross section.

16. The swivel toilet seat unit according to claim 14, wherein the lid and the toilet seat are formed from a material chosen from a group of materials consisting of plastic, wood, and metal.

17. The swivel toilet seat unit according to claim 14, wherein the top side of the toilet seat is padded.

18. The swivel toilet seat unit according to claim 14, wherein the toilet seat is U-shaped.

19. The swivel toilet seat unit according to claim 14, wherein the toilet seat is circular-shaped.

* * * * *